US006139349A

United States Patent [19]

Wright

[11] Patent Number: 6,139,349

[45] Date of Patent: Oct. 31, 2000

[54] ELECTRICAL CONNECTOR WITH TACTILE FEEDBACK

[75] Inventor: John O. Wright, York, Pa.

[73] Assignee: Osram Sylvania Inc., Danvers, Mass.

[21] Appl. No.: 09/122,149

[22] Filed: Jul. 24, 1998

[51] Int. Cl.[7] ..... H01R 13/52

[52] U.S. Cl. ..... 439/271

[58] Field of Search ..... 439/152, 153, 439/156, 159, 271, 140, 141, 592, 923

[56] References Cited

U.S. PATENT DOCUMENTS

| | | | |
|---|---|---|---|
| 2,281,739 | 5/1942 | Wright | 439/271 |
| 3,926,494 | 12/1975 | Maillaro | 439/131 |
| 4,655,526 | 4/1987 | Shaffer | 439/268 |
| 4,698,027 | 10/1987 | Vandame | 439/271 |
| 5,029,973 | 7/1991 | Rink | 385/60 |
| 5,466,164 | 11/1995 | Miyazaki et al. | 439/140 |

*Primary Examiner*—Lincoln Donovan
*Assistant Examiner*—Michael C. Zarroli
*Attorney, Agent, or Firm*—William H. McNeill

[57] ABSTRACT

An electrical connector which includes mating first and second connector bodies each including mating respective first and second contacts. Locking members are provided for locking the first and second connector bodies together in a connected mode. The second connector includes an elastic member which is engaged and compressed by the first and second connector bodies in the connected mode. The elastic member is decompressed, and thereby facilitates the disconnection of the first and second connector bodies, in a disconnected mode.

14 Claims, 2 Drawing Sheets

ELECTRICAL CONNECTOR WITH TACTILE FEEDBACK

TECHNICAL FIELD

The present invention relates to an electrical connector. More particularly, the present invention relates to an electrical connector for use with, for example, an antenna connector.

BACKGROUND ART

Typical electrical connectors such as, for example those used with an antenna connector for an antenna cable such as that used in the automobile industry for radios include a male connector body generally in the form of a plug and a female connector body generally in the form of a ferrule which forms a socket. In use, the male connector body is plugged into the female connector body to effect a mechanical and electrical connection between the two. Typically, an antenna cable in the form of a coaxial cable is electrically and mechanically attached to one of the connectors such as the male connector, and the other connector, such as the female connector, is electrically and mechanically attached to a circuit such as a circuit on a printed circuit board. In such electrical connectors there is a tendency for the male and female components to become unintentionally disconnected due to opposing axially directed forces which are sometimes inadvertently exerted upon the male connector relative to the female connector. In addition, the lack of satisfactory tactile feedback makes it difficult to know when a suitable connection has been made.

SUMMARY OF THE INVENTION

It is, therefore, an object of the present invention to obviate the disadvantages of the prior art.

It is an object of the present invention to provide an improved electrical connector.

It is a further object of the present invention to provide an electrical connector which provides visual evidence of an incomplete connection.

It is yet another object of the present invention to provide an electrical connector the use of which permits the user to rely upon more than one means of tactile feedback to determine whether a complete connection has been made.

It is another object of the present invention to provide an electrical connector which facilitates disconnection thereof.

Yet another object of the present invention is to provide an electrical connector which prevents inadvertent disconnection thereof.

Another object of the present invention is to provide an electrical connector for use as an antenna connector.

This invention achieves these and other objects, in one aspect of the invention, by providing an electrical connector which comprises a first connector body and a second connector body which may be connected together. The first connector body extends in a first direction of a first longitudinal axis from a first end to a second end and comprises a first contact and at least one first locking member. The second connector body extends in a second direction of a second longitudinal axis from one end to another end and comprises a second contact and at least one second locking member. The second locking member is structured and arranged for engagement with the first locking member in a connected mode and disengagement from the first locking member in a disconnected mode. An elastic member is provided which is structured and arranged for (a) engagement with and compression between the first connector body and the second connector body in the connected mode and (b) decompression in the disconnected mode.

BRIEF DESCRIPTION OF THE DRAWINGS

This invention may be clearly understood by reference to the attached drawings in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
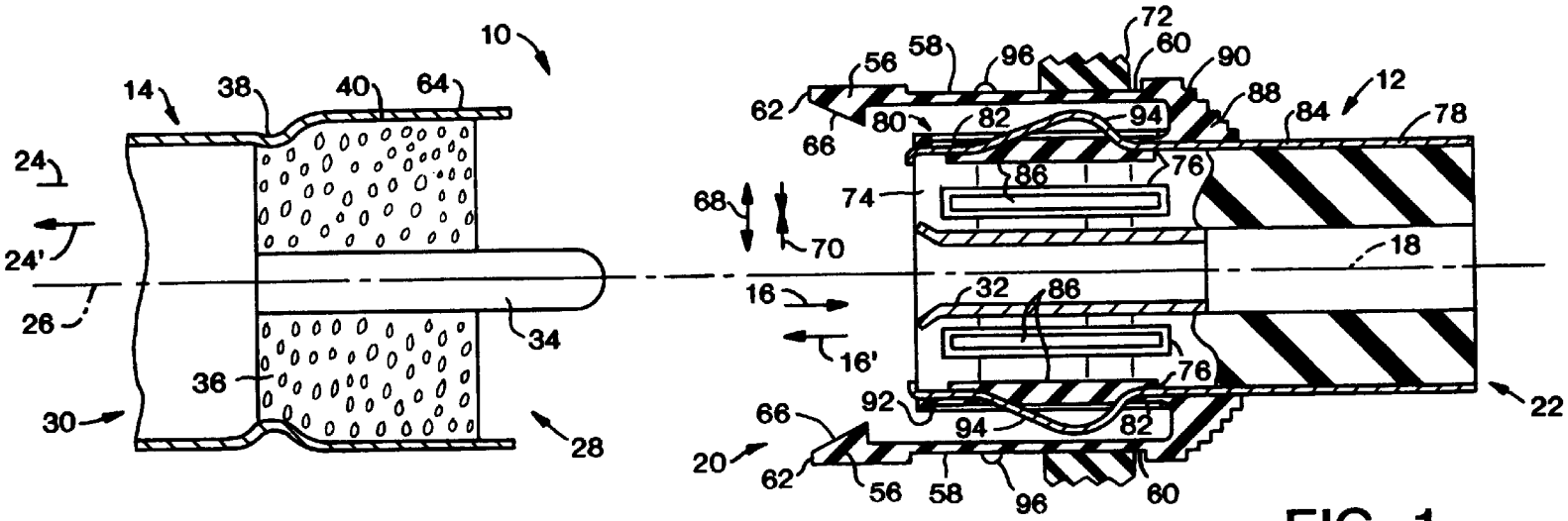
FIG. 1 is a view of one embodiment of the electrical connector of the present invention in a disconnected mode.
Figure 2:
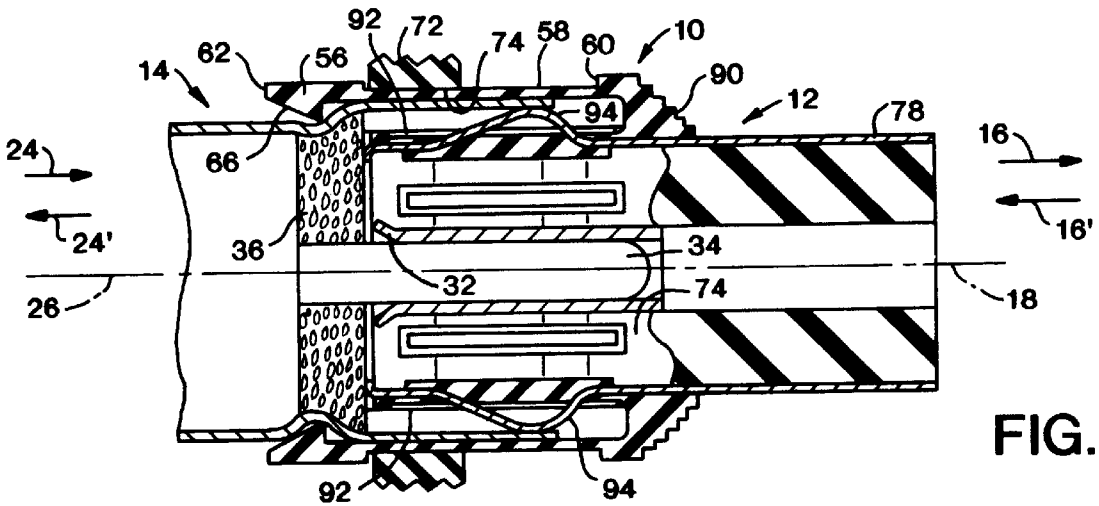
FIG. 2 is a view of the electrical connector of FIG. 1 in a connected mode.

The embodiment of this invention which is illustrated in the drawings is particularly suited for achieving the objects of this invention. FIGS. 1 and 2 depict one embodiment of the electrical connector of the present invention. Without limitation, the electrical connector of FIGS. 1 and 2 may be for use as an antenna connector. In particular, FIGS. 1 and 2 depict an electrical connector 10 which comprises a first connector body 12 and a second connector body 14. The first connector body 12 extends in the direction 16, 16' of a first longitudinal axis 18 from a first end 20 to a second end 22. The second connector body 14 extends in the direction 24, 24' of a second longitudinal axis 26 from one end 28 to another end 30. When the first connector body 12 is connected to the second connector body 14, axes 18 and 26 will be coincident as depicted in FIG. 2. In the embodiment of FIGS. 1 and 2, the first connector body 12 and the second connector body 14 are each generally cylindrical.

The first connector body 12 comprises a first contact 32, illustrated as a female contact formed by a ferrule in a conventional manner, and the second connector body 14 comprises a mating second contact 34, illustrated as a male contact formed by a prong in a conventional manner.

The second connector body 14 comprises an elastic member 36 contained therein. In the embodiment illustrated in FIGS. 1 and 2, the male contact 34 is concentric with and extends through the elastic member 36. The elastic member 36 is structured and arranged for engagement and compression between the first connector body 12 and the second connector body 14 in a connected mode, and decompression in a disconnected mode. For example, FIG. 1 depicts the first connector body 12 disconnected from the second connector body 14 and the elastic member 36 decompressed. Movement of one or both of the connector bodies 12, 14 towards the other as the male prong 34 is inserted into the female ferrule 32 will cause the end 20 of the first connector body 12 to engage and compress the elastic member 36 as illustrated in FIG. 2. Movement of one or both of the connector bodies 12, 14 away from the other as the male prong 34 is removed from the female ferrule 32 will cause the elastic member 36 to decompress and thereby exert a force in direction 24 against end 20 of the first connector body 12 thereby facilitating removal of the prong 34 from the ferrule 32 and disconnection of the electrical connector 10.

The elastic member of the present invention may be contained within the second connector body of the present invention in any desired manner. For example, the elastic member may be force fitted into the second connecting body. In an alternative mode, an adhesive may be provided between the elastic member and the second connector body. In the embodiment illustrated in FIGS. 1 and 2, the elastic member 36 is contained within the cylindrical connector body 14 by the indentation provided by the circumferentially extending groove 38 which is depressed into the outer surface 40 of the elastic member. Of course, any combination of the foregoing, or any other containing means, may be used to contain the elastic member in place relative to the second connector body.

Figure 3:
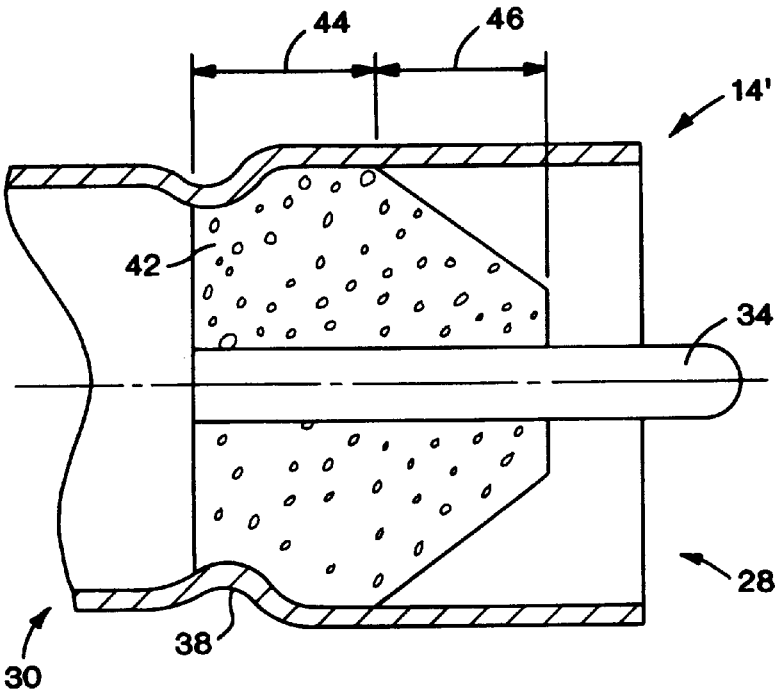
FIG. 3 is a view of an alternative embodiment of a connector body of the electrical connector of the present invention.

The shape and size of the elastic member of the present invention can be varied as required to provide the force required to urge the connector bodies 12 and 14 away from each other in the disconnected mode. For example, in the embodiment illustrated in FIGS. 1 and 2, the elastic member 36 is generally cylindrical. FIG. 3 illustrates an alternative elastic member 42 contained within a connector body 14' identical to connector body 14 in all other respects. In particular, the elastic member 42 comprises a first length 44 positioned between end 28 and end 30 of the connector body 14'. A second length 46 is adjacent the first length 44 and extends towards end 28. The second length 46 is in the shape of a truncated cone which converges towards the end 28 as illustrated in FIG. 3. Contact 34 is concentric with and extends through the elastic member 42.

Figure 4:
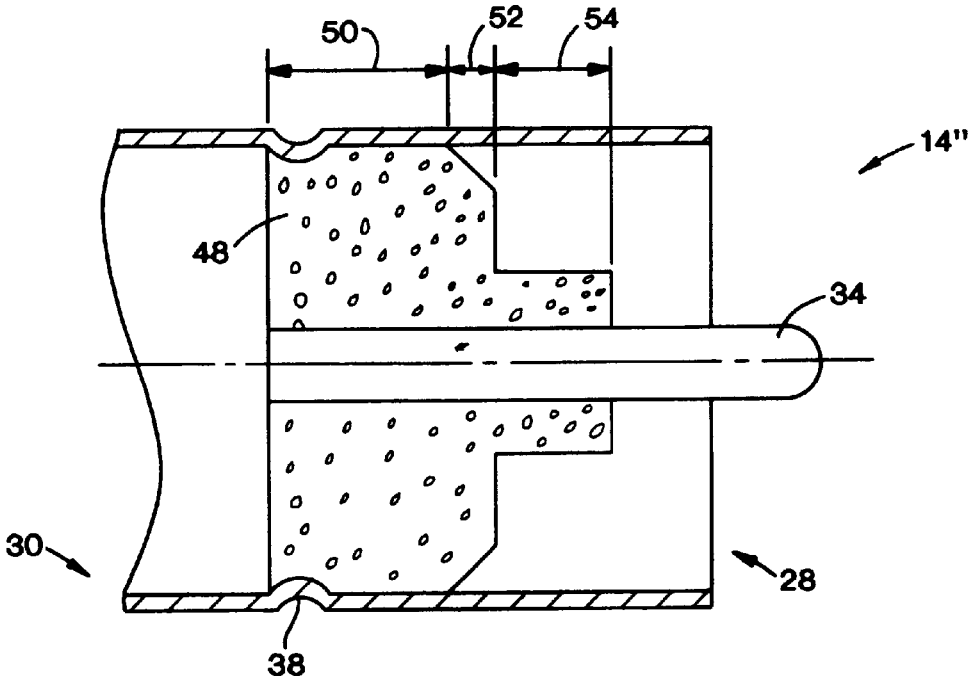
FIG. 4 is a view of another alternative embodiment of a connector body of the electrical connector of the present invention.

In an alternative embodiment illustrated in FIG. 4, an elastic member 48 is provided within a connector body 14" identical to connector body 14 in all other respects. Elastic member 48 comprises a first length 50 positioned between end 28 and end 30 of the connector body 14". A second length 52 is adjacent the first length 50 and extends towards end 28. The second length 52 is in the shape of a truncated cone which converges towards the end 28 as illustrated in FIG. 4. A third length 54 is adjacent to and extends from the second length 52 towards end 28. The third length 54 is in the shape of a cylinder.

When effecting connection between the connector bodies 12 and 14, it is desirable to be assured that there is complete electrical and mechanical connection and that such connection will not be inadvertently disconnected. To this end, the electrical connector of the present invention provides structural features which accomplish these objects. In particular, the first connector body of the present invention includes at least one first locking member, and the second connector body includes at least one second locking member. The locking members are structured and arranged for engagement with each other in a connected mode and disengagement from each other in a disconnected mode. The elastic member of the present invention will be structured and arranged for engagement with and compression between the first connector body and the second body in the connected mode and decompression in the disconnected mode. The engagement of the locking member prevents inadvertent disengagement and also provides one form of tactile feedback as the first latch members snap into the second latch member. The decompression of the elastic member pushes one connector body away from the other thereby providing a visual indication that the connector bodies are not completely connected. When the user is holding the device, such decompression also provides another form of tactile feedback indicating incomplete connection. By pushing one connector body away from the other, the elastic member also facilitates complete removal of one contact from the other. All of the foregoing will be evident from the following discussion of FIGS. 1 and 2.

In the electrical connector 10 illustrated in FIGS. 1 and 2, the first connector body 12 includes two first locking members in the form of two latch members 56 each of which extends from a respective resilient latch arm 58. More or less latch arms 58 and latch members 56 may be provided as desired. Each latch arm 58 extends in the direction 16 16' of longitudinal axis 18 from a proximate end 60 to a distal end 62. Each latch arm 58 includes a first latch member 56 at end 62. The second connector body 14 includes a second locking member in the form of second latch member which is structured and arranged for engagement with the first latch members in a connected mode and disengagement from the first latch members in a disconnected mode. In particular, the circumferentially groove 38 extending into the outer surface 64 of the second connector body 14 provides a second latch member. With reference to FIG. 1, it will be apparent that the outer surface 64 of the second connector body 14 is structured and arranged to engage the bevelled surface 66 of the latch members 56 as the first connector body 12 is being moved in direction 16' to thereby cam the resilient latch arms 58 apart in direction 68 away from longitudinal axis 18. The latch arms 58 are dimensioned such that when the contacts 32 and 34 are fully electrically connected as desired, the latch members 56 will be urged towards each other by the resilience of the latch arms 58 in direction 70 towards longitudinal axis 18 and into the second latch member provided by groove 38 to provide mechanical connection between the connector bodies 12 and 14. The engagement between the latch members 56 and the latch member or groove 38 will prevent inadvertent disconnection of the connector bodies 12 and 14.

In the embodiment illustrated in FIGS. 1 and 2, the first connector body 12 includes a latch ring 72 through which the latch arms 58 extend such that the latch ring may be caused to slide in the direction 16, 16' from the proximate end 60 of the latch arms 58, in an unlocked mode, to the distal end 62, in a locked mode. In use, when the connector bodies 12 and 14 are in the connected mode and the latch members 56 are in engagement with the groove 38, the latch ring 72 may be caused to slide in direction 16' towards the distal end 62 of each latch arm 58 as illustrated in FIG. 2. By dimensioning the latch ring 72 such that its inner surface 74 engages the latch arms 58 adjacent distal end 62, the connector 10 will be in a locked mode to the extent that so long as the latch ring is in such position, the latch arms cannot be moved in direction 68 thereby assuring that the latch members 56 can not be removed from groove 38. In order to disconnect the connector 10, the latch ring 72 is merely caused to slide in direction 16 towards the proximate end 60 of the latch arms 58 thereby freeing the latch arms 58 for movement in direction 68 thereby permitting removal of the latch members 56 from groove 38.

In the embodiment illustrated in FIGS. 1 and 2, the first connector body 12 comprises a conductive shell 74 which includes at least one aperture 76 which extends through a peripheral wall 78 of the shell. In the embodiment illustrated in FIGS. 1 and 2 there is a plurality of apertures 76 which extend in the direction 16, 16' of axis 18. Contact 32 is positioned within the shell 74 in a conventional manner. A mounting member 80 is mounted within the shell 74. In particular, mounting member 80 includes a first portion 82 adjacent an upper surface 84 of the wall 78 and a second portion 86 extending from the first portion into an aperture 76. In the embodiment illustrated in FIGS. 1 and 2 there is a plurality of second portions 86 each of which extends into a respective aperture 76. The proximate ends 60 of the latch arms 58 are attached to the first portion 82 such that the latch arms 58 and latch members 56 form a part of the mounting member 80. As a practical matter, each latch arm 58 provides an elongated flexible segment which is coupled to the first portion 82 and cantilevered from the proximate end 60 to the distal end 62.

In order to facilitate attachment of the mounting member 80 to the shell 74, the mounting member 80 may be in the form of a plurality of flexible legs extending from a base portion 88 of the mounting member, such flexible legs extending in the direction 16, 16" and being formed by each first portion 82 and each second portion 86. Four of such legs are illustrated in FIGS. 1 and 2. In assembling together the shell 74 and mounting member 80, the shell and mounting member may be structured and arranged such that as the shell is inserted into the mounting member the shell cams the flexible legs apart in direction 68 until each leg is adjacent a respective aperture 76 at which time each leg snaps in direction 70 into an aperture 76 to hold the mounting member in place relative to the shell. In order to facilitate connecting the first connector body 12 and the second body 14 as described herein, the first portion 82 may include a ribbed surface 90 adjacent the proximate end 60 of the latch arms 58.

In the embodiment illustrated in FIGS. 1 and 2, the mounting member 80 includes at least one hole 92 which extends therethrough and the shell 74 comprises at least one beam 94 which extends into hole 92. In the embodiment illustrated in FIGS. 1 and 2, there is a plurality of elongated holes 92 and a plurality of beams 94, which extend in the direction 16, 16' of axis 18. Each hole 92 is positioned between a pair of second portions 86 and each beam 94 has a length which extends into a respective hole 92.

In the embodiment of FIGS. 1 and 2, the mounting member may include means to retard movement of the latch ring 72 when it is in the locked position adjacent distal end 62 of the latch arms 58. For example each latch arm 58 may include detents in the form of protuberances 96 which snap into a depression (not shown) in surface 74 of the latch ring 72 as the latch ring is moved from the proximate end 60 of the latch arm 58 to the distal end 62. To this end, the latch ring 72 may be somewhat resilient to accommodate the protuberances 96 during movement of the latch ring. For example, the latch ring 72 may be split or cored to provide the desired flexibility.

Fabrication of the various components described herein may be accomplished using conventional procedures. For example, latch ring 72 and mounting member 80 may be molded from a plastic material. Shell 74, ferrule 32 and male connector 34 may be stamped from a metal sheet and then rolled and bent to form the desired configuration. Elastic member 36 may be fabricated in a conventional manner from an elastomer.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. An electrical connector, comprising:

a first connector body extending in a first direction of a first longitudinal axis from a first end to a second end and comprising a first contact and at least one first locking member, and a second connector body extending in a second direction of a second longitudinal axis from one end to another end and comprising a second contact and at least one second locking member structured and arranged for engagement with said at least one first locking member in a connected mode and disengagement from said at least one first locking member in a disconnected mode, and an elastic member structured and arranged for engagement with and compression between said first connector body and said second connector body in said connected mode and decompression in said disconnected mode, said elastic member being substantially cylindrical and being positioned within said second connector body and comprising a first length positioned between said one end and said another end, and a second length adjacent said first length and extending towards said one end, said second length being in the shape of a truncated cone converging towards said one end, said second contact being concentric relative to said elastic member.

2. The electrical connector of claim 1 wherein said elastic member comprises a third length adjacent said second length, said third length being in the shape of a cylinder extending from said second length toward said one end.

3. An electrical connector, comprising:

a first connector body extending in a first direction of a first longitudinal axis from a first end to a second end and comprising a first contact and at least one resilient latch arm extending in said first direction from a proximate end to a distal end and including a first latch member at said distal end, said first connector body further comprising a latch ring having an inner surface which engages said latch arm, said latch ring being moveable in said first direction between said proximate end in an unlocked mode and said distal end in a locked mode; and a second connector body extending in a second direction of a second longitudinal axis from one end to another end and comprising a second contact and at least one second latch member structured and arranged for engagement with said first latch member in a connected mode and disengagement from said first latch member in a disconnected mode, and an elastic member structured and arranged for engagement with and compression between said first connector body and said second connector body in said connected mode and decompression in a disconnected mode.

4. The electrical connector of claim 3 wherein said first connector body comprises a conductive shell which comprises at least one aperture which extends through a peripheral wall of said shell, said first contact being positioned within said shell, and further including a mounting member attached to said shell, said mounting member including a first portion adjacent an upper surface of said wall and a second portion extending from said first portion into said aperture, said proximate end of said latch arm being attached to said first portion.

5. The electrical connector of claim 4 wherein said mounting member comprises a plurality of flexible legs, each leg of said plurality of flexible legs being formed by a first portion and a second portion.

6. The electrical connector of claim 4 wherein said at least one aperture comprises a plurality of elongated apertures which extend in said first direction and are spaced from each in a third direction which is circumferential relative to said longitudinal axes, and further wherein said at least one second portion includes a plurality of second portions, each second portion extending into a respective aperture.

7. The electrical connector of claim 6 wherein said at least one first connector body comprises a latch ring having an inner surface which engages said latch arm, said latch ring being moveable in said first direction between said proximate end in an unlocked mode and said distal end in a locked mode.

8. The electrical connector of claim 7 wherein said at least one latch arm comprises a plurality of latch arms, each latch arm comprising an elongated flexible segment which is cantilevered from said proximate end to said distal end and is equally spaced in said third direction from an adjacent elongated flexible segment.

9. The electrical connector of claim 4 wherein said first portion comprises a ribbed surface adjacent said proximate end.

10. The electrical connector of claim 4 wherein said mounting member includes at least one hole which extends through an outer wall of said mounting member, and further wherein said shell comprises at least one beam, said beam having a length which extends into said hole.

11. The electrical connector of claim 10 wherein said at least one hole includes a plurality of elongated holes which extend in said first direction and are spaced from each other in said third direction, each hole being positioned between a pair of second portions, and further wherein said at least one beam includes a plurality of beams which extend in said first direction and are spaced from each other in said third direction, each beam having a length which extends into a respective hole.

12. The electrical connector of claim 11 wherein said at least one first connector body comprises a latch ring having an inner surface which engages said latch arm, said latch ring being moveable in said first direction between said proximate end in an unlocked mode and said distal end in a locked mode.

13. The electrical connector of claim 12 wherein said elastic member is within said second connector body and comprises a first length positioned between said one end and said another end and a second length adjacent said first length and extending towards said one end, said second length being in the shape of a truncated cone converging towards said one end, said second contact being concentric relative to said elastic member.

14. The electrical connector of claim 13 wherein said elastic member comprises a third length adjacent said second length, said third length being in the shape of a cylinder extending from said second length toward said one end.

* * * * *